US006205619B1

(12) United States Patent
Jang

(10) Patent No.: US 6,205,619 B1
(45) Date of Patent: Mar. 27, 2001

(54) HYDRAULIC AUTOMATIC-SHOCK-ABSORBING HINGE DEVICE

(76) Inventor: Jong-bok Jang, #707-4, Kuro-2 dong, Kuro-ku, Seoul (KR)

( * ) Notice: Subject to any disclaimer, the term of this patent is extended or adjusted under 35 U.S.C. 154(b) by 0 days.

(21) Appl. No.: 09/154,987

(22) Filed: Sep. 17, 1998

(51) Int. Cl.[7] ..... E05F 3/20
(52) U.S. Cl. ..... 16/352; 16/54; 16/50
(58) Field of Search ..... 16/54, 352, 52, 16/50, 53, DIG. 21

(56) References Cited

U.S. PATENT DOCUMENTS

| | | | | |
|---|---|---|---|---|
| 4,155,144 | * | 5/1979 | Koganei | 16/54 |
| 4,485,522 | * | 12/1984 | Chen | 16/54 |
| 5,152,029 | * | 10/1992 | Pai | 16/54 |
| 5,419,013 | * | 5/1995 | Hsiao | 16/54 |
| 5,855,040 | * | 1/1999 | Lin | 16/50 |

FOREIGN PATENT DOCUMENTS 156093 10/1998 (KR) .

* cited by examiner

*Primary Examiner*—Anthony Knight
*Assistant Examiner*—Mark Williams
(74) *Attorney, Agent, or Firm*—Jacobson, Price, Holman & Stern, PLLC

(57) ABSTRACT

In a hinge device, right-hand spiral cams formed on a lower portion of a rotational shaft are engaged with right-hand spiral guides grooves, and left-hand inclinated guide protrusions are engaged with left-hand spiral guide grooves formed on an outer circumference of an elevating pipe. When the elevating pipe moves upwardly or downwardly, the load produced by hydraulic pressure can be applied uniformly to the shaft. Therefore, it is improbable to break out or cut out the spiral cam formed on the shaft, the spiral guide grooves on the elevating pipe and the guide protrusion on the stationary pipe. As a result, the hinge device has a relatively long life-time. Also, the hinge device can reduce or prevent damage in respect of life and property.

7 Claims, 7 Drawing Sheets

HYDRAULIC AUTOMATIC-SHOCK-ABSORBING HINGE DEVICE

This invention relates to an automatic hydraulic shock-absorbing hinge device. More particularly, it relates to the hinge device which can close the door slowly or automatically under a shock-absorbing state or a state of emergency such as a high-temperature environment due to a fire.

BACKGROUND OF THE INVENTION

In the prior art, a hinge has played only a connection between a door and a framework thereof. The hinge is made separatedly from a shock-absorbing device which moves the door to be closed slowly and automatically and which is typically located on the upper portion of the door and connected between the door and the framework.

The shock-absorbing device is so complicated that trouble shooting thereof frequently takes place. And the device has to be installed only onto the upper portion of the door in a manner that the device is exposed out of the door. Therefore, in the shock-absorbing device of the prior art, there are problems in the installation on the restricted area, from an aesthetic point of view and high cost.

In order to solve the above problems, the inventor of the present invention disclosed Korean Patent No. 156093 which had been granted and entitled "HYDRAULIC AUTOMATIC SHOCK-ABSORBING HINGE" wherein the hinge has a piston on the end thereof and a cylinder having a reciprocating pipe therein. The piston has a switching valve and a check valve. A right-hand spiral groove and a left-hand spiral groove are formed opposedly with each other and on the reciprocating pipe.

A right-hand spiral cam is protruded on one side of the rotational shaft. And the right-hand spiral cam is engaged with the right-hand spiral groove and a bolt threadly engaged with the cylinder is inserted in the left-hand spiral groove to keep the balance under the movement of the cam in the upward or downward direction.

The hydraulic hinge having the construction mentioned above, has a good effect of shocking-absorbing. But when the right-hand spiral groove is moving upwardly or downwardly along the right-hand spiral groove such that buffering effect takes place by hydraulic pressure, the spiral cam applies a highly excessive load to the rotational shaft on the one side thereof, so that the shaft and the bolt engaged threadly with the cylinder may be broken out or cut out.

OBJECT AND SUMMARY OF THE INVENTION

It is an object of the present invention to provide an automatic hydraulic shock-absorbing hinge device which is designed such that when moving upwardly or downwardly along the right-hand spiral groove, the right-hand spiral cam can apply the load to the rotational shaft uniformly and as little as possible.

In accordance with the invention, an automatic hydraulic shock-absorbing hinge device comprises: an outer moving body formed integrally with one coupling piece, including the first uneveness portion formed vertically on the upper end and inner circumference portion of the outer moving body. A cylinder disposed in the inner lower portion of the outer moving body includes a "|" shaped flowing path on the one side thereof, and a oil supplement tank on the outer circumference thereof. An oil leackage-preventing cover threadly engages with the outer moving body on the lower end portion of the body for sealing the lower end of the cylinder. A stationary pipe threadly engages and is fixed with the outer moving body on the middle and inner circumference portion of the body, and the stationay pipe includes a pair of the left-hand inclinated guide protrusions opposedly with each other. An elevating pipe inserted within the stationary pipe. The elevating pipe includes a pair of the left-hand spiral guide grooves on the outer circumference and opposed portions with each other and a pair of the right-hand spiral grooves on the inner circumference and opposed portions with each other. The pair of the left-hand spiral grooves are engaged and guided with the guide protrusions of the stationary pipe. A piston disposed on the lower end of the elevating pipe and is inserted in the cylinder for being moved upwardly and downwardly. The piston includes a check valve on the middle and end portion thereof. A rotational shaft is disposed on the upper porion of the outer moving body. The shaft includes a pair of the right-hand spiral cams protruded and opposed with each other on the lower portion of the shaft and a restricting wheel having an oil leakage-preventing 0-ring fitted therearound on the upper end of the cams, wherein the pair of the right-hand spiral cams can be engaged and guided with the right-hand spiral guide grooves of the elevating pipe. A support pipe for supporting the shaft, includes the second uneveness portion formed vertically on the lower and outer circumference portion of the support pipe and engaged with the first uneveness portion for preventing the outer moving body and the support pipe from idling with each other. A recess groove formed along and on the outer circumference of the support pipe and matched with a vertical removal-preventing snab ring. A first cap and second cap fitted respectively, on both upper end and lower end of another coupling piece. An oil leakage preventing cover around which the second cap is fitted includes a coil spring within the second cap, of which one end is fixed on the oil leackage preventing cover, and of which another end is fixed on the lower cover.

In a preferred embodiment, the piston may be formed independently from the elevating pipe. In this case, the piston and elevating pipe are connected with each other by a connecting means which may be integrally formed with the piston.

In accordance with such a construction, when the elevating pipe moves upwardly or downwardly, the load produced by hydraulic pressure can be applied uniformly to the shaft. Therefore, it is not possible to break out or cut out the spiral cam formed on the shaft, the spiral guide grooves on the elevating pipe, and the guide protrusion on the stationary pipe. As a result the hinge device of the present invention has a relatively longer life-time than the prior art.

BRIEF DESCRIPTION OF THE DRAWING FIGURES

A preferred embodiment of the invention is discussed in detail below with reference to the attached drawing figures, wherein.

DETAILED DESCRIPTION OF THE PREFERRED EMBODIMENTS

Figure 1:
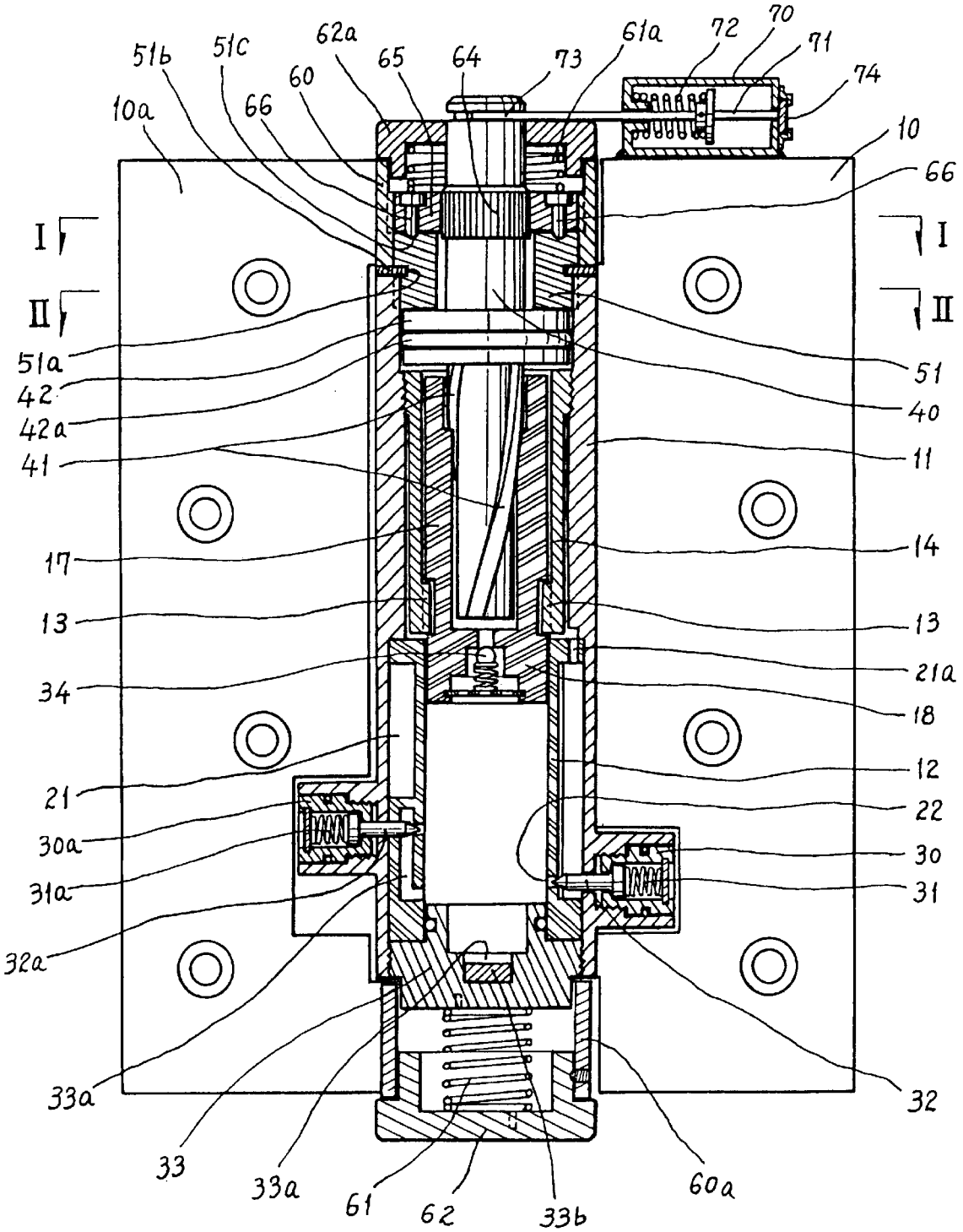
FIG. 1 is a longitudinal sectional view of the main portion of the automatic hydraulic shock-absorbing hinge device constructed in accordance with an embodiment of the present invention.

A preferred embodiment of an automatic hydraulic shock-absorbing hinge device constructed in accordance with the present invention is illustrated in FIG. 1. The hinge device includes an outer moving body 11 integrally combined with a coupling piece 10. A cylinder 12 is disposed in the lower portion of the outer moving body 11. The cylinder 12 includes a tropezoidal shaped flowing path 20 formed on one side thereof, an oil supplement tank 21 formed therearound, and an oil discharging port 22 formed on the lower portion thereof.

The flowing path 20 and the oil discharging port 22 are connected with respectively, riddle valves 32 and 32*a* which are controlled by adjusting bolts 30 and 30*a*, and pressed against by coil springs 31 and 31*a*, respectively. In the FIG. 1, reference No. "21*a*" designates an oil introducing port which constitutes an oil passage together with the tropezoidal shaped flowing path 20 and the oil discharging port 22. As constructed and as mentioned above in connection with the hinge device, the riddle valves 32 and 32*a* are opened upon a shocking hydraulic pressure generated within the cylinder 12. so that the oil passage extends enlargely to cause the shock-absorbing effect to be produced in it. Of course, the riddle valves 32 and 32*a* are not opened without the shocking pressure generated within the cylinder 12. Therefore the hinge device of the present invention always and continuosly causes the door to close slowly near the end portion of the door moving interval, regardless of the shocking pressure.

An oil leakage preventing cover 33 is threadly engagaed with the outer moving body 11 on the lower end portion thereof to seal the cylinder 12 on the lower end of it in order to prevent the cylinder 3 from leaking the oil. On the cover 33 is formed a recess 33*a* having a magnet 33*b* inserted in it. The magnet 33*b* always attracts the particles or powders of iron generated in the hinge device upon operating thereof to clean the oil in the cylinder 12.

Figure 2:
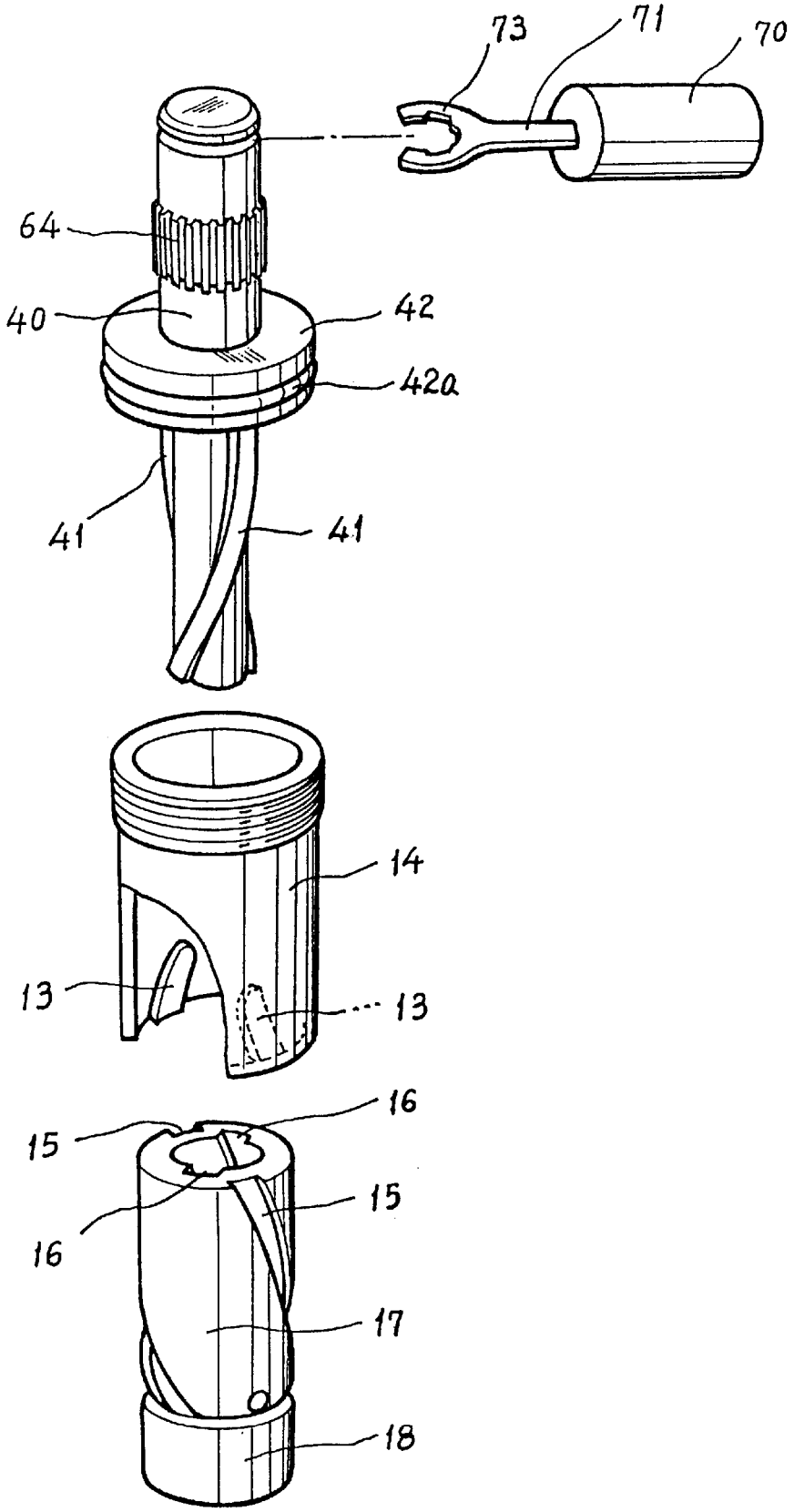
FIG. 2 is a partly exploded perspective view of the main portion of the hinge device.

As shown in FIG. 2, a stationary pipe 14 having a left-hand-inclinated guide protrusion 13 on the lower end is threadedly engaged with the outer moving body 11 on the inner and middle portion thereof. And the stationary pipe 14 is inserted in the elevating pipe 17. The pipe 17 has a pair of left-hand spiral guide grooves 15 opposedly with each other on the outer surface thereof, and a pair of right-hand spiral guide grooves 16 opposed with each other on the inner surface thereof. The guide protrusion 13 is engaged with the left-hand spiral grooves 15 of the elevating pipe 17. A piston 18 is integrally formed on the lower end portion of the elevating pipe to move upwardly and downwardly within the cylinder 12. The piston 18 has a check valve 34 on the center thereof.

Figure 5:
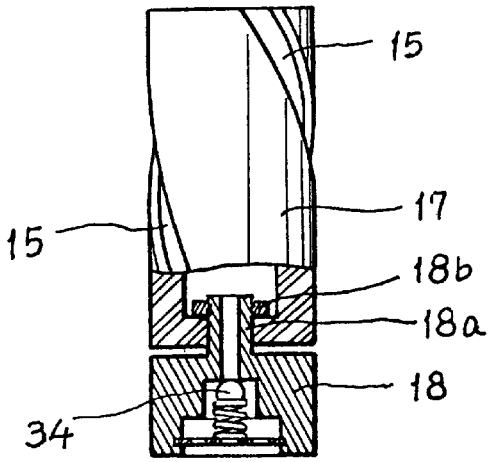
FIGS. 5 and 6 are the sectional views of main portion in accordance with another embodiment of the present invention.
Figure 6:
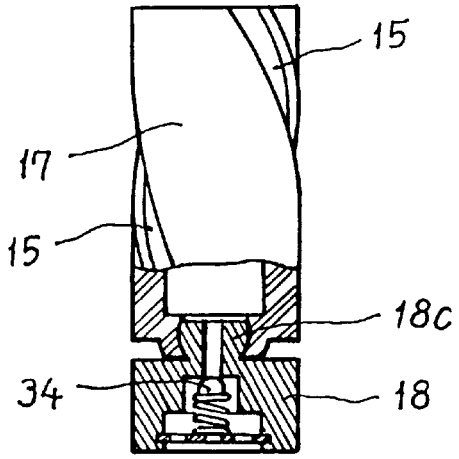
Figure 7:
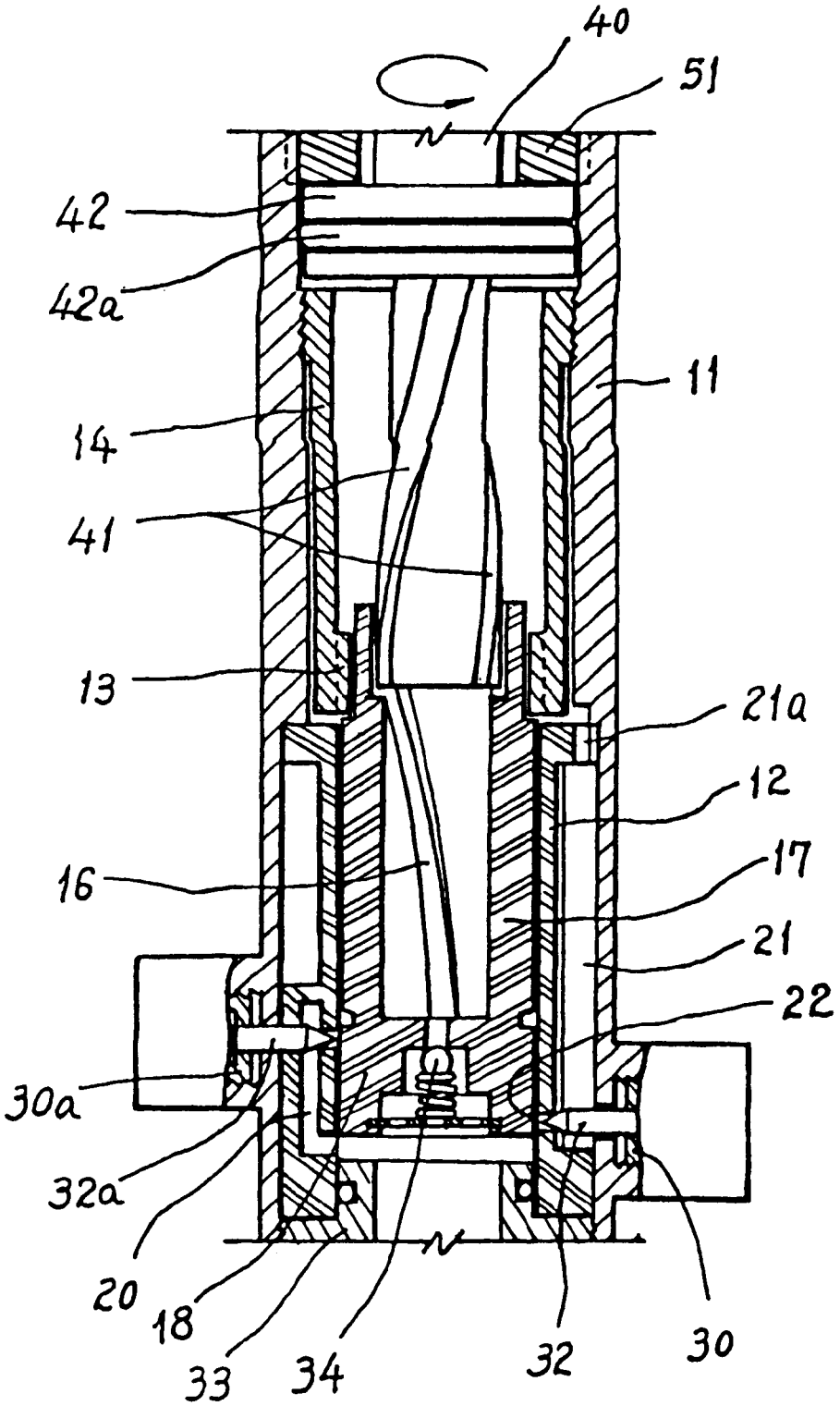
FIGS. 7 and 8 are sectional veiws of the illustration where the piston is brought down.
Figure 8:
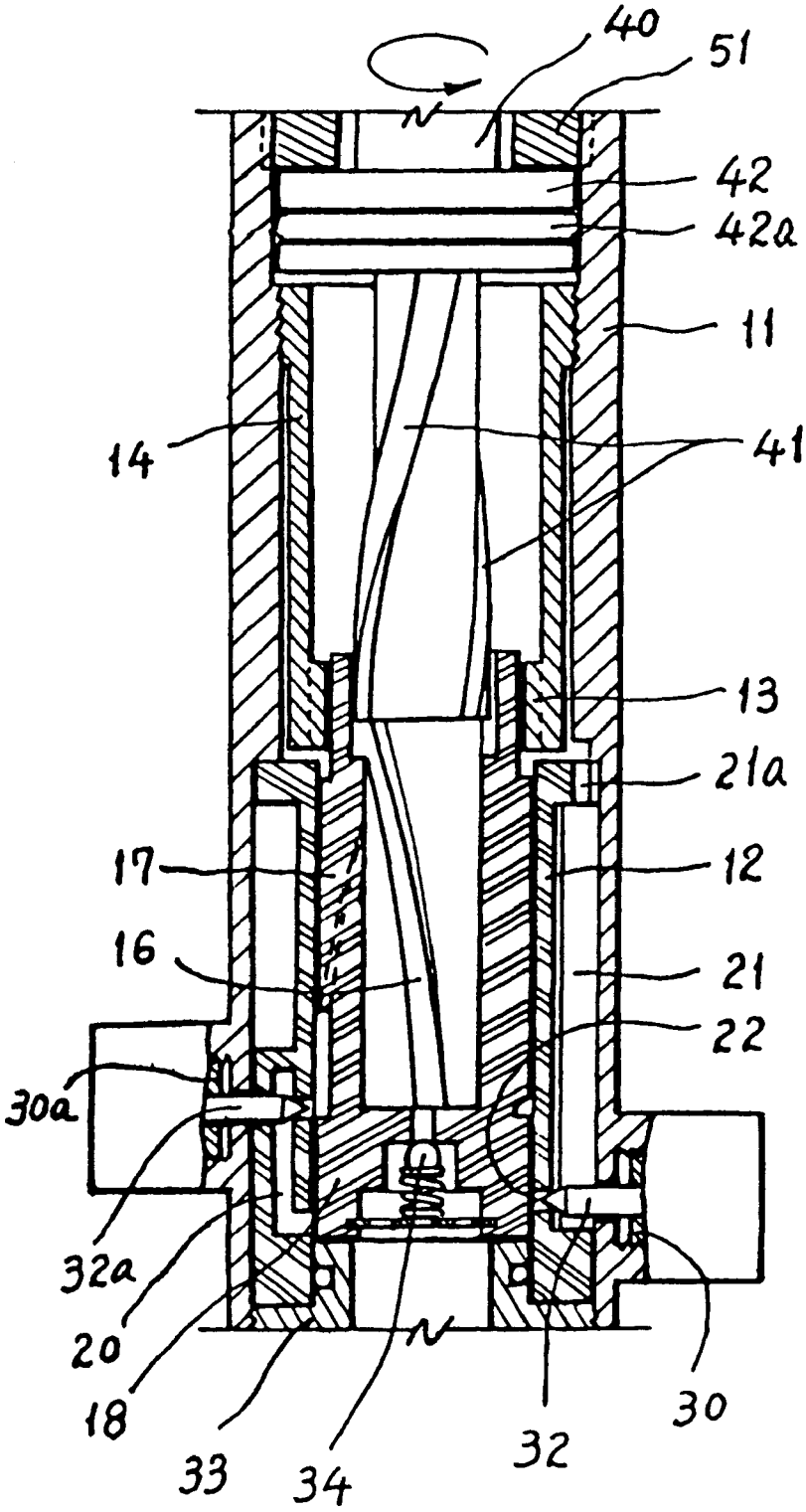

Alternatively, as shown in FIG. 5 and 6. the piston 18 may be formed independently from the elevating pipe 17. In this case, the piston 18 and the elevating pipe 17 are connected with each other in a manner that a connecting pipe 18*a* integrally formed with the piston 18 is threadedly engaged with the lower end portion of the elevating pipe 17, and fixed with the nut 18*b*. And as another alternative, a head portion 18*c* integrally formed on the piston 18 may be inserted on the lower end portion of the elevating pipe 17 to combine them with each other.

On the upper portion of the outer moving body 11 is disposed on a rotational shaft 40 having a pair of right-hand spiral cams 41 opposed with each other and protruded on the lower portion thereof. The spiral cams 41 are engaged with the right-hand spiral guide grooves 16. As constructed and mentioned above, the elevating pipe 17 can move upwardly and downwardly along the rotation direction of the shaft 40 , in turn, to cause the piston 18 to move vertically within the cylinder 12. When the piston 18 is moving downwardly and closing both the tropezoidal shaped flowing path 20 and the oil discharging port 22, at the same time and instantly, the piston 18 stops moving downwardly, and after a short time later it starts to move downwardly.

As shown in FIG. 2, on the upper end of the right-hand spiral cam 41 is formed a restricting wheel 42 inserted in the outer moving body 11. An O-ring 42*a* is fitted with the wheel 42 therearound to prevent the outer moving body 11 from leaking the oil in it.

Figure 3:
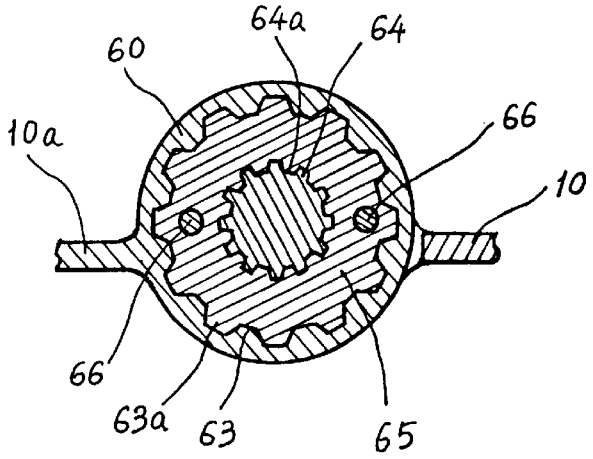
FIG. 3 is a sectional view taken along the line I—I of FIG. 1.
Figure 4:
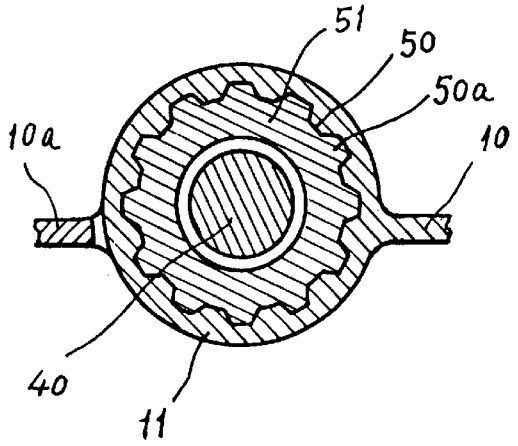
FIG. 4 is a sectional view taken along the line II—II of FIG. 1

As shown in FIG. 4, an uneveness portion 50 having prominence and depression alternatively in regular intervals is formed vertically on the inner and upper circumference of the outer moving body 11. And an uneveness portion 50*a* is formed on the lower portion and circumference of a support pipe 51. The pipe 51 supports the rotational shaft 40. The uneveness portion corresponds to and is engaged with the unenveness portion 50. The engagement between the uneveness portions 50 and 50*a* restrict the idling rotation of the support pipe 51. As shown in FIG. 1, on the middle and outer portion of the support pipe 51 is formed a recess groove 51*a* in which a removal-preventing snap ring 51*b* is fitted to prevent the support pipe 51 from being removed in the vertical direction. As shown in FIG. 1 and FIG. 3, the caps 60 and 60*a* are formed integrally with the coupling piece 10*a* on the upper and lower end portions thereof, respectively. The lower cap 60*a* having a coil spring 61 in it is inserted in the oil leaking-preventing cover 33. The upper end of the coil spring 61 is fixed on the cover 33, and lower end of it fixed on a cover 62 so that the door combined with the coupling pieces 10 and 10*a* may be automatically closed by the spring force of the spring 61. As mentioned above, because the recess 33*a* of the cover 33 has the magnet 33*b* in it, the magnet always attracts the particles of iron to clean the oil within the cylinder 12. As a result, the cleaned oil can smoothly flow upwardly and downwardly within the cylinder 12.

The upper cap 60 is inserted in the outer circumference of the support pipe 51. An uneveness portion 63 is formed vertically on the inner and middle surface of the cap 60. The uneveness portion 63 is engaged with an uneveness portion 63*a* formed vertically on the outer circumference of a coupling ring 65. And on the inner circumference of the coupling 65 is formed vertically an eveness portion 64*a* engaged with an uneveness portion 64 which is also formed vertically on the rotational shaft 40.

Figure 9:
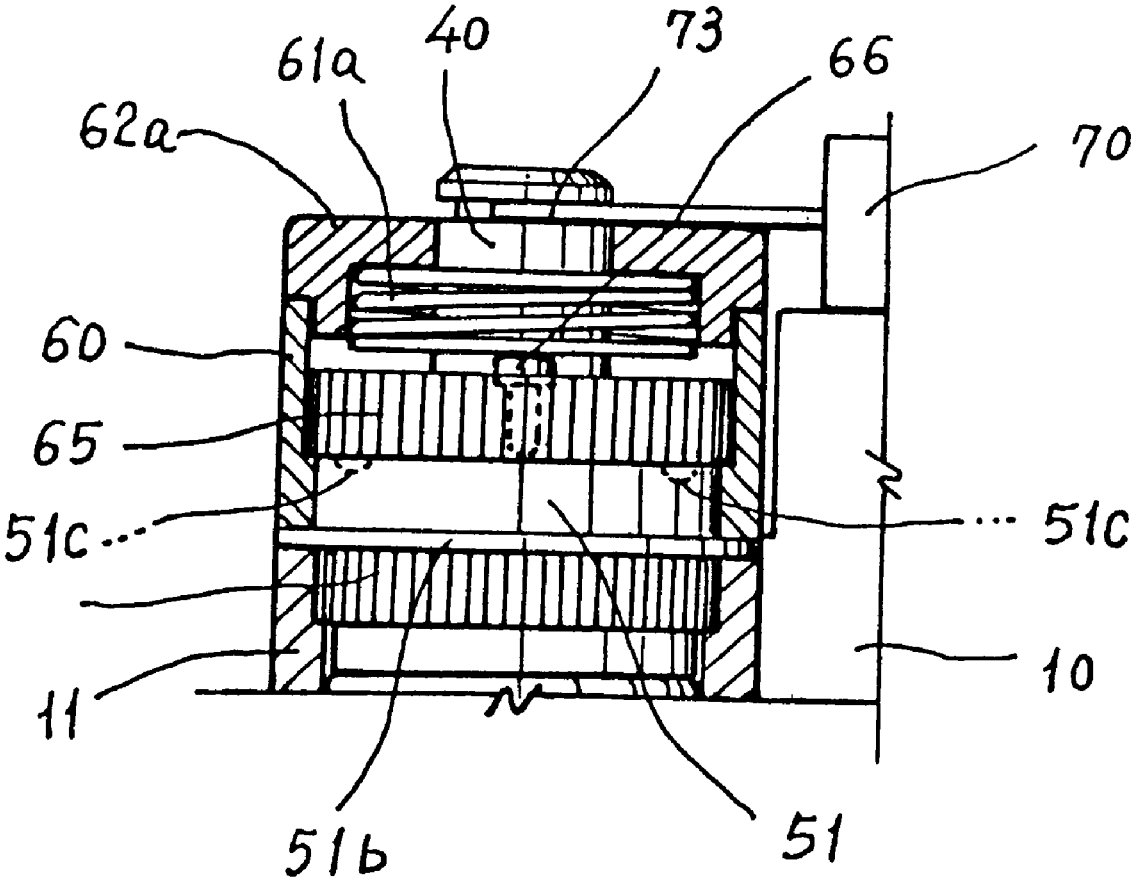
FIG. 9 is a partly sectional view of the upper portion of the hinge device of the present invention.

As shown in FIG. 3 and FIG. 1, a maintaining pin 66 penetrates the coupling ring 65 from the upper end thereof to be coupled with a maintaining groove 51*c* formed on the upper end of the support pipe 51, so that the pin 66 and the groove 51*c* can maintain the state of the door closed or opened, and the pin 66 moves along the upper end surface of the support pipe 51 during the door closing or opening as shown in FIG. 9. A coil spring 61*a* is disposed on the upper portion of the coupling ring 65. A cover 62*a* is covered on the cap 60 such that the upper end of the rotational shaft 40 is protruded and exposed from the cover 62*a*, and the coil spring 61*a* is compressed by the cover 62*a*. A cylinder 70 having a connecting rod 71 and a coil spring 72 in it is disposed on one side of the hinge device. The connecting rod 71 having the bracket 73 on the one end thereof connects the cylinder 70 with the rotational shaft 40 such that the bracket 73 is fitted and fixed on the exposed upper end of the rotational shaft 40, under spring forces of the coil spring 72. And the bracket 73 suppresses the cover 62*a* so that it cannot leap out in spite of spring force of the coil spring 61*a*. The other end of the connecting rod 71 is fusibly connected with the cylinder 70 by soldering lead 74, so that the connection between the rod 71 and the cylinder 70 can be melted and broken out under the predetermined high temperature generated by, for example, a fire-break-out.

If the connection is broken out by melting the lead 74, the connection rod 71 retracts backwardly from the exposed end of the shaft 40 and the bracket is released from the shaft 40. In turn, the cover 62*a* leaps out from the hinge device by spring force of the spring 61 and the maintaining pin 66 which has penetrated the coupling ring 65 by spring force of the coil spring 61*a* removes from the maintaining groove 51*c* of the support pipe 51 so that the door combined with the hinge device is closed slowly by the spring force of the coil spring 61.

In the case that the hinge device of the above structure is connected between the door and the framework, when opening the door the coil spring 61 in the cap 60*a* is wound up to rotate the shaft 40 fixed on the upper cap 60 via coupling ring 65. According to the rotation of the shaft 40, the elevating pipe 17 moves upwardly because the right-hand spiral cam 41 of the shaft 40 is engaged with the right-hand guide groove 16 formed on the inner circumference of the pipe 17. And the upward movement of the pipe 17 causes the piston 18 to move upwardly so that the oil existing on and above the upper portion of the piston 18 enters into the interior of the cylinder 12. The piston 18 is formed integrally with or independently from the pipe 17 as mentioned above.

On the contrary, when closing, the door is automatically closed by the spring force of the coil spring 61 which has already been wound up. The shaft 40 fixed on the upper cap 60 rotates in reverse direction opposite to that of the opening case so that the elevating pipe 17 moves downwardly through the guide groove 16 engaged with the spiral cam 41. The downward movement of the pipe 17 produces the hydraulic pressure of the oil within the cylinder 12 to urge the oil to enter the oil discharging port 22 of the oil supplement tank 21 via the controlled riddle valve 32 and 32*a*, and the upper portion above the piston 18 via trapezoidal shape flowing path 20. The flowing of oil produces the buffering effect in the cylinder 12 to slowly close the door.

As the piston 18 further moves downwardly and it closes the trapezoidal shaped flowing path 20 and the oil discharging port 22, at the same time and instantly, the door stops closing. In the state of stopping, the oil is flowing through the gap between the cylinder 12 and the piston 18 by the spring force of the spring 61 so that if the flowing path 20 is opened, the riddle valve operates to delay the closing speed of the door and generate the shock-absorbing effect.

In the hinge device of the present invention, the right-hand spiral cams formed on the lower portion of the rotational shaft 40 are engaged with the right-hand spiral guide grooves 16, and the left-hand inclinated guide protrusions 13 are engaged with the left-hand spiral guide grooves 15 formed on the outer circumference of the elevating pipe 17.

In accordance with such a construction, when the elevating pipe 17 moves upwardly or downwardly, the load produced by hydraulic pressure can be applied uniformly to the shaft 40. Therefore, it is little possible to break out or cut out the spiral cam 15 formed on the shaft 40, the spiral guide grooves 15 and 16 on the elevating pipe 17 and, the guide protrusion 13 on the stationary pipe 14. As a result, the hinge device of the present invention has a relatively longer life-time than prior art.

In the hinge device of the present invention, the cap 60 on the coupling piece 10*a* is fitted on the outer circumference of the support pipe 51, and the shaft 40 is engaged with the coupling ring 65 through the uneveness portions 64 and 64*a* thereof. In turn, the coupling ring 65 is engaged with the cap 60 through the uneveness portion 63*a* on the outer circumference of the ring 65 and the uneveness portion 63 on the inner circumference of cap 60.

As described above, a maintaining pin 66 penetrates the coupling ring 65 from the upper end thereof to be coupled with the maintaining groove 51*c* formed on the upper end of the support pipe 50. Therefore the pin 66 and the groove 51*c* can maintain the state of the closed or opened door and the pin 66 moves along upper end of the support pipe 51 during the door closing or opening as shown in FIG. 9.

The coil spring 61*a* is disposed on the upper portion of the ring 65. The cover 62*a* is covered on the cap 60 such that the upper end of the rotational shaft 40 is protruded from and exposed on the cover 62*a*, and the coil spring 61*a* is compressed by the cover 62*a*. The cylinder 70 having a connecting rod 71 and a coil spring 72 in it is disposed on one side of the hinge device. The connecting rod 71 having the bracket 73 on the one end thereof connects the cylinder 70 with the rotational shaft such that the bracket 73 is fitted and fixed on the exposed upper end of the rotational shaft 40 under spring force of the coil spring 72. And the bracket 73 suppresses the cover 62*a* so that it cannot leap out in spite of spring force of the coil spring 61*a*. The other end of the connecting rod 71 is fusibly connected with the cylinder 70 by soldering lead 74 such that the connection between the rod 71 and the cylinder 70 can be melted and broken out under the predetermined high temperature generated by, for example, a fire-break-out. If the connection is broken out by melting, the connecting rod 71 retreats backwardly from the exposed end of the shaft 40 and the bracket 73 is divided and released from the shaft 40. In turn, the cover 62*a* leaps out from the hinge device by the spring force of the spring 61. And following it, the maintaining pin 66 which has penetrated the coupling ring 65 by spring force of the coil spring 61*a* removes from the maintaining groove 51*c* of the supporting pipe 51, so that the opened door combined with the hinge device is closed slowly by the spring force of the coil spring 61. As a result, the hinge device of the present invention can reduce or prevent the damage in respect of life and property.

Although the invention has been illustrated and disclosed with reference to the preferred embodiment, it is understood that substitutions may be made and equivalents employed herein, without departing from the scope of the invention as set forth in the claims.

What is claimed is:

1. An automatic hydraulic shock-absorbing hinge device comprising:

an outer moving body formed integrally with one coupling piece, including a first uneveness portion formed vertically on an upper end and inner circumference portion of the outer moving body;

a cylinder disposed in an inner lower portion of the outer moving body including a flow path on the one side thereof, and an oil supplement tank on an outer circumference thereof;

an oil leak preventing cover threadedly engaged with the outer moving body on the lower end portion of the body for sealing the lower end of the cylinder;

a stationary pipe threadedly engaged and fixed with the outer moving body on a middle and inner circumference portion of the body, and the stationary pipe including a pair of left-hand inclinated guide protrusions extending opposedly with each other;

an elevating pipe inserted within the stationary pipe, and the elevating pipe including a pair of left-hand spiral guide grooves on the outer circumference and having opposed potions with each other and a pair of right-hand spiral grooves on the inner circumference and having opposed portions with each other, so that the pair of the left-hand spiral grooves are engaged and guided with the guide protrusions of the stationary pipe;

a piston disposed on a lower end of the elevating pipe and inserted in the cylinder for being moved upwardly and downwardly, and the piston including a check valve on a middle and end portion thereof;

a rotational shaft disposed on an upper portion of the outer moving body, and the shaft including a pair of right-hand spiral cams protruded and opposed with each other on a lower portion of the shaft and a restricting wheel having an oil leakage preventing 0-ring fitted therearound on an upper end of the cams, wherein the pair of the right-hand spiral cams can be engaged and guided with the right-hand spiral guide grooves of the elevating pipe;

a support pipe for supporting the shaft, including a second uneveness portion formed vertically on a lower and outer circumference portion of the support pipe and engaged with the first uneveness portion for preventing the outer moving body and the support pipe from idling with each other, and a recess groove formed along and on the outer circumference of the support pipe and matched with a vertical removal-preventing snap ring;

a first cap and a second cap fitted, respectively, on both upper end and lower end of another coupling piece;

an oil leakage preventing cover around which the second cap is fitted; and a coil spring within the second cap, of which one end is fixed on the oil leakage preventing cover, and of which another end is fixed on a lower cover.

2. The hinge device as claimed in claim 1, wherein the first cap is combined with the support pipe on the outer circumference of the pipe and the cap has a third uneveness portion on the middle and inner circumference thereof; and the rotational shaft has a fourth uneveness portion formed vertically on the outer circumference thereof;

the hinge device further comprises;

a coupling ring which has a fifth uneveness portion formed vertically on the inner circumference thereof and a sixth uneveness portion formed vertically on the outer circumference thereof, so that the rotational shaft is coupled with the coupling ring through the fourth uneveness portion engaged with the fifth uneveness portion, and in turn, the coupling ring is coupled with the first cap through the sixth unevenness portion engaged with the third unevenness portion;

a maintaining pin which penetrates the coupling ring from the upper portion thereof;

a recess groove formed on the upper surface of the support pipe for receiving the end of the maintaining pin so that the pin and the groove are engaged with each other;

a coil spring disposed on the upper portion of the coupling ring;

an upper cover for depressing the coil spring and exposing the upper end of the shaft on the top of the cover;

a cylinder disposed on one side of the hinge device, including a connecting rod and a coil spring in it, wherein the connecting rod having a bracket on the one end thereof connects the cylinder with the rotational shaft such that the bracket is fitted and fixed on the exposed upper end of the rotational shaft under spring force of the coil spring, the bracket suppresses the cover so that the cover cannot leap out by spring force of the coil spring, and the other end of the connecting rod is fusibly connected with the cylinder by soldering lead.

3. The hinge device as claimed in claim 1, wherein riddle valves which are controlled by adjusting bolts and depressed by a coil spring are combined with the flow path and an oil discharging port so that under a shocking hydraulic pressure, the riddle valves can be opened to extend the whole oil passage to produce a buffering effect, and under normal and uniform hydraulic pressure, the riddle valves operate normally, as a result, to close the door slowly at the end portion of the door movement interval.

4. The hinge device as claimed in claim 1, wherein the oil leakage preventing cover has a recess in the inner portion thereof, for receiving the magnet which attracts the particle or powder of iron generated during the operating of the hinge device.

5. The hinge device as claimed in the claim 1, wherein the piston is formed independently and separately from any article, and has a connecting pipe integrally formed with it so that the piston can be fixedly coupled with the elevating pipe by the connecting pipe threadedly engaged with the end of the elevating pipe.

6. The hinge device as claimed in claim 1, wherein the piston is formed independently and separately from the elevating pipe, and has a head portion integrally formed with it so that the piston can be fixedly coup-led with the elevating pipe by the head portion inserted in the end portion of the elevating pipe.

7. The hinge device as claimed in the claim 1, wherein the maintaining pin penetrates the coupling ring from the upper portion thereof and the recess groove formed on the upper surface of the support pipe for receiving the end of the maintaining pin so that the pin and groove cooperate to maintain the state of the door closed or opened, and when the door is closing or opening, the pin moves on and along the upper surface of the support pipe.

* * * * *